United States Patent [19]

Tanaka et al.

[11] 4,225,166

[45] Sep. 30, 1980

[54] LOCK STRIKER WITH RETRACTABLE KEEPER BAR

[75] Inventors: Jiro Tanaka, Tokyo; Yoshimasa Tsuchiya, Sayama, both of Japan

[73] Assignee: Nissan Motor Company, Limited, Yokohama, Japan

[21] Appl. No.: 30,325

[22] Filed: Apr. 16, 1979

[30] Foreign Application Priority Data

May 12, 1978 [JP] Japan ..... 53/55491

[51] Int. Cl.[2] ..... E05C 13/00

[52] U.S. Cl. ..... 292/341.17; 292/DIG. 43

[58] Field of Search ..... 292/341.17, 341.18, 292/DIG. 43, 341.14, 340

[56] References Cited

U.S. PATENT DOCUMENTS

| | | | |
|---|---|---|---|
| 938,926 | 11/1909 | Weidel | 292/341.17 X |
| 2,741,505 | 4/1956 | Courney | 292/341.17 |
| 3,514,142 | 5/1970 | Smith | 292/341.17 X |
| 3,560,038 | 2/1971 | Gunther | 292/341.17 X |

*Primary Examiner*—Richard E. Moore

[57] ABSTRACT

A bracket is secured to a wall member of a luggage compartment to define therebetween an enclosed space within which a swingable plate is disposed. A keeper bar secured to the swingable plate is projectable beyond the bracket into the compartment when the swingable plate is swung to a first predetermined position and is retractable into the enclosed space when the swingable plate is swung to a second predetermined position. A spring is arranged to bias the swingable plate to swing toward the first predetermined position holding the keeper bar to project into the compartment. If the keeper bar having been projected is pushed against the force of the spring, it is retracted into the space.

10 Claims, 8 Drawing Figures

LOCK STRIKER WITH RETRACTABLE KEEPER BAR

FIELD OF THE INVENTION

The present invention relates in general to a mechanism for latching a lid element of an automobile, such as an engine hood, a trunk lid, a tail gate, or a door element, such as a side door, a hatch back door, in closed position. More particularly, the present invention is concerned with a lock striker of the latching mechanism, the lock striker functioning to catch a hook member of the lid or door element to provide positive closure of the element.

BACKGROUND OF THE INVENTION

In a luggage compartment lid latching mechanism or the like, it is usual that a keeper bar of the lock striker is securely fixed to an inner wall of the compartment in a manner to be projected considerably into the compartment. This arrangement, however, will cause not only obstruction to loading and unloading of luggage into and from the compartment but also high possibility of breakage of the luggage or damage of the striker itself. In fact, it sometimes happens that the fixed keeper bar tends to catch and tear the wear of the operator handling the luggage in the compartment.

OBJECTS OF THE INVENTION

Therefore, it is an essential object of the present invention to provide an improved latching mechanism which is free of the problems having been encountered in the above-mentioned conventional latching mechanism.

It is an object of the present invention to provide an improved lock striker having a retractable keeper bar which is retracted into an enclosed space against a biasing force when pushed toward the space by a predetermined force.

According to the present invention, there is provided a mechanism for latching a first member to a second member, comprising a bracket secured to the second member to define a certain space between the bracket and the second member, a base member stationarily disposed in the space, a swingable plate swingably supported at a portion thereof by the base member, the plate being swingable between first and second positions in the space, a keeper bar secured to the plate, the keeper bar being projected beyond the bracket when the plate takes the first position and being retracted into the space when the plate takes the second position, biasing means for biasing the plate to swing in a direction to take the first position, and a hook member connected to the first member, the hook member being engageable with the keeper bar in the projecting state to latch the first member to the second member when the first member is moved toward the second member.

SUMMARY OF THE DRAWINGS

Other objects and advantages of the present invention will become clear from the following description when taken in conjunction with the accompanying drawings, in which.

DESCRIPTION OF THE EMBODIMENT

Figure 1:
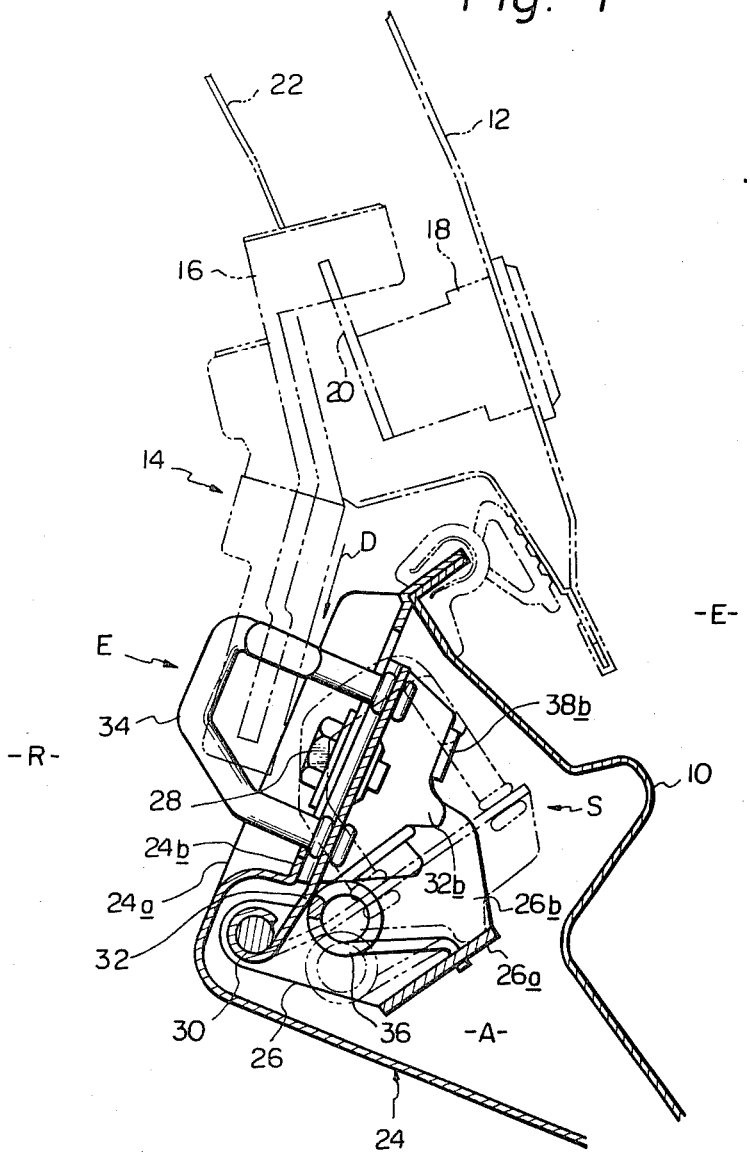
FIG. 1 is a partial sectional view of a rear luggage compartment of a vehicle, showing an improved latching mechanism of the present invention incorporating a lid of the compartment.
Figure 2:
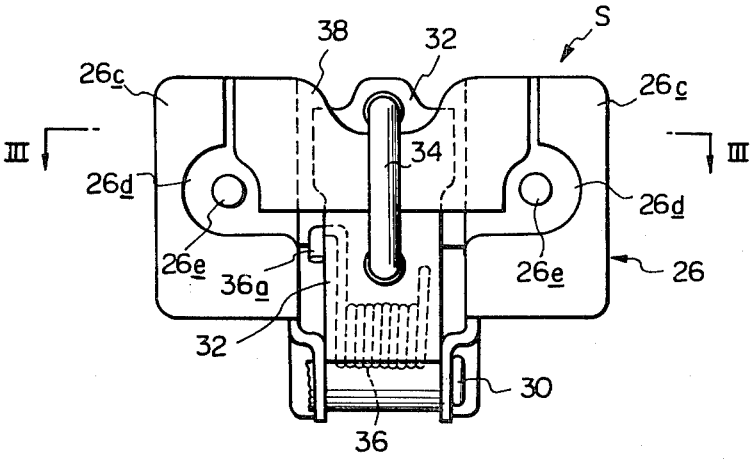
FIG. 2 is a front view of a lock striker which constitutes part of the latching mechanism of FIG. 1.

Referring to FIG. 1 of the drawings, there is illustrated a part of a rear luggage compartment of a vehicle, equipped with an improved lid latching mechanism of the invention. The luggage compartment, which is generally designated by reference "R", has a rear end panel 10 by which the exterior "E" of the vehicle and the interior of the luggage compartment "R" are bounded. An upper section of the rear end panel 10 is constructed to form an enclosed space "A" in which a later-mentioned lock striker (S) is disposed. Designated by numeral 12 is a lid or trunk lid which is hinged at its upper end to the vehicle body. The lower end of the trunk lid 12 is provided with a conventional hook mechanism 14. The hook mechanism 14 has a hook 16 which is passively engaged with a later-mentioned retractable U-shaped keeper bar (34) for latching therebetween when the lid 12 is swung down in the direction D to close the luggage compartment "R". Denoted by numeral 18 is a key cylinder having an arm 20 which functions to move the hook 16 in a direction to disengage the same from the keeper bar 34 when a key (not shown) in the key cylinder 18 is turned in a predetermined direction. Denoted by numeral 22 is a wire which usually leads to a driver's compartment so that disengagement of the hook 16 from the keeper bar 34 can be remotely made by the driver by only operating or pulling the wire 22.

Figure 5:
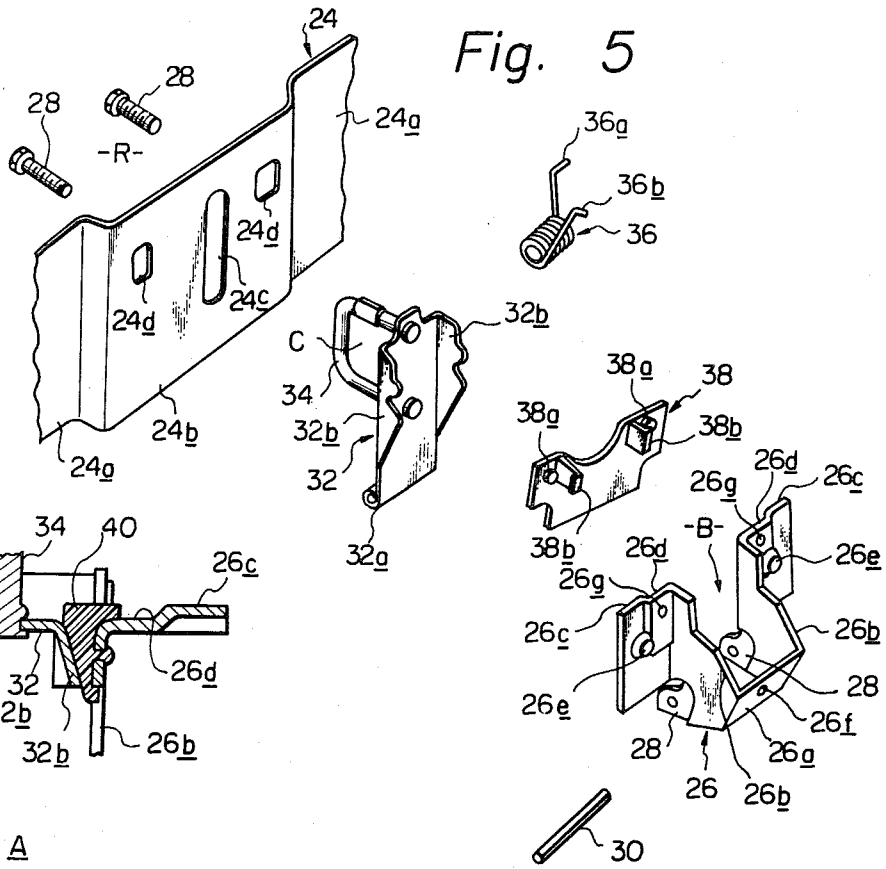
FIG. 5 is an exploded view of the lock striker.

The lock striker "S" of the invention comprises a bracket 24 which is connected to the upper section of the rear end panel 10 at a position where the hook 16 reaches when the lid 12 takes the closed position. As is best seen in FIG. 5, the bracket 24 is constructed to have a recessed flat section **24*b* and flange sections 24*a*, the flange sections 24*a* extending laterally outwardly from the recessed flat section 24*b* to be secured to the upper section of the rear end panel 10 of the vehicle. By the reason as will become clear hereinlater, the recessed flat section 24*b* is formed with an elongate hole 24*c* and two small holes 24*d* between which the elongate hole 24*c*** is positioned, as shown.

Secured to the bracket 24 is a generally U-shaped base plate 26 which is spacedly disposed in the enclosed space "A" formed by the rear end panel 10. The base plate 26 comprises a bottom section **26*a*, parallel side wall sections 26*b* extending at right angles from the bottom section 26*a*, and flange sections 26*c* laterally outwardly extending from the leading ends of the side wall sections 26*b*. Each of the flange sections 26*c* is formed with not only a recess 26*d* at a position where the flange section extends from the corresponding side wall section 26*b* but also a threaded hole 26*e*. A pair of shaft holders 28 are secured to the side wall sections 26*b* respectively for holding a shaft 30 therebetween. A pair of fastening bolts 28 pass through the small holes 24*d* of the bracket 24 to be screwed in the threaded holes 26e of the generally U-shaped base plate 26 to complete the tight connection between the base plate 26 and the bracket 24. A swingable plate 32 is swingably supported at its rounded lower section 32a on the shaft 30 so that the plate 32 is swingable about the shaft 30 within a space "B" which is defined by the bottom section 26a and the side wall sections 26b of base plate 26 and the recessed flat section 24b of the bracket 24, as shown. A generally U-shaped keeper bar 34 is fixed at its leg portions to the swingable plate 32 in a manner that when the swingable plate 32 swings in a direction to approach the bracket 24, the keeper bar 34 is smoothly inserted into the elongate hole 24c of the bracket 24 and then projected into the luggage compartment "R" of the vehicle. A coil spring 36 lies between the swingable plate 32 and the bottom section 26a of the base plate 26, engaging at its one end 36a to one of side walls 32b of the swingable plate 32 and disposing its other end into a hole 26f formed in the bottom section 26a of the base plate so that the swingable plate 32 is biased to swing in a direction to approach the bracket 24**.

Figure 3:
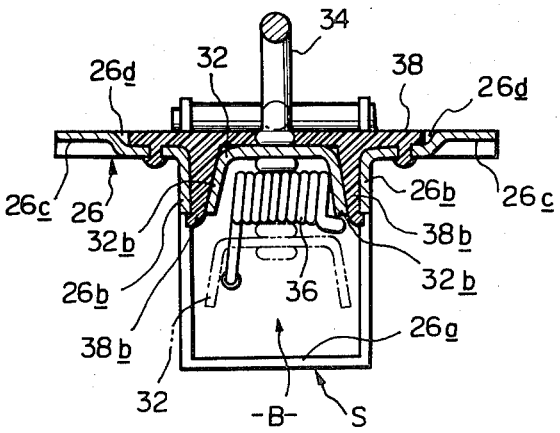
FIG. 3 is a sectional view taken along the line III—III of FIG. 2.
Figure 4:
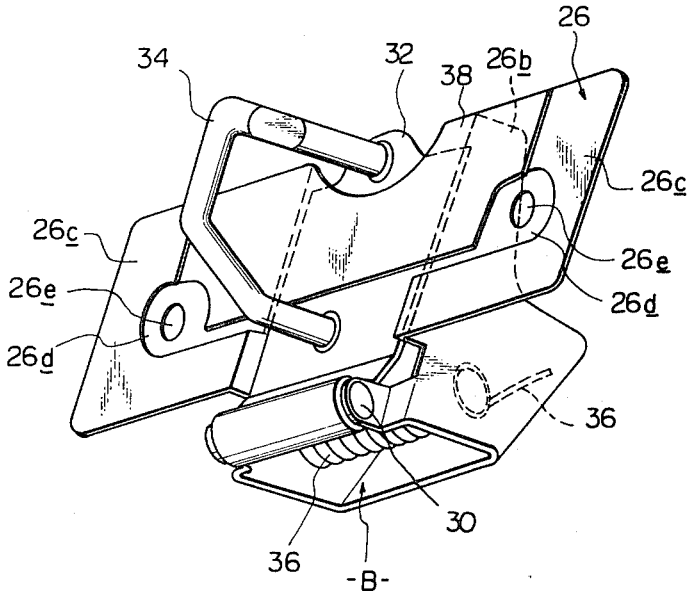
FIG. 4 is a perspective view of the lock striker.

A stopper plate 38 made of suitable plastics is bridged between the recess 26d of the flange sections 26c of the base plate 26 in a manner to pass through a clearance "C" defined by the keeper bar 34 and the swingable plate 32, so that the swingable plate 32 is swingable between the stopper plate 38 and the bottom section 26a of the base plate 26. Preferably, the stopper plate 38 is arranged flush with the main parts of the flange sections 26c of the base plate 26, as shown in FIG. 3. Two bosses 38a integrally formed on the stopper plate 38 are snuggly disposed in respective holes 26g formed in the flange sections 26c of the base plate 26, and two wedge-shaped projections 38b extending from the stopper plate 38 are hooked at their bent ends to shoulder sections (no numerals) of the side wall sections 26b of the base plate 26, so that tight connection between the stopper plate 38 and the base plate 26 is achieved with proper location of the stopper plate 38 with respect to the base plate 26. Now, it should be noted that at normal state of the swingable plate 32, it is kept in contact with the stopper plate 38, by the force produced by the spring 36, permitting the keeper bar 34 to be projected through the elongate hole 24c of the bracket 24 into the luggage compartment "R". Thus, if the keeper bar 34 having been projected into the luggage compartment "R", as is shown by solid line in FIG. 1, is pushed by a predetermined force in the direction of "E", that is toward the base plate 26, the keeper bar 34 is swung or moved with the swingable plate 32 into the space "B" (see FIG. 5) of the base plate 26 and stops at the position, shown by phantom line in FIG. 1, where the keeper bar 34 is in contact with at least a section of the stopper plate 38. It is desirable that the keeper bar 34 is retracted at least to such a degree that the head of the keeper bar 34 is flush with the flange sections 24a of the bracket 24. As is understood from FIG. 3, the wedge-shaped projections 38b of the stopper plate 38 are arranged and constructed so as to make tight positioning of the keeper bar 34 in the projected state with respect to the elongate hole 24c of the bracket 24 by contacting the side walls 32b of the swingable plate 32 to the inside slanted surfaces of the projections 38b.

With the above, it will be appreciated that the retractable arrangement of the keeper bar 34 of the lock striker "S" prevents occurrence of the before-mentioned several drawbacks, such as obstruction to loading and unloading of luggage into and from the luggage compartment "R" and high possibility of breakage of the luggage or damage of the keeper bar itself which has been caused by a fixed keeper bar of the conventional lock strikers. Furthermore, by the presence of the wedge-shaped projections 38b of the stopper plate 38, the locating of the keeper bar 34 in the projected state with respect to the elongate hole 24c of the bracket 34 is assured so that the insertion and withdrawal of the keeper bar 34 into and from the elongate hole 24c are smoothly made.

Figure 6:
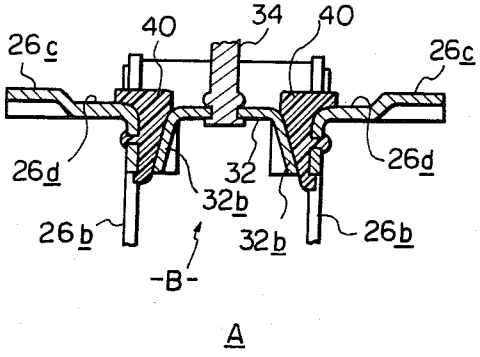
FIG. 6 is a sectional view similar to FIG. 3, but shows a modification of the lock striker.

FIG. 6 shows a modification of the lock striker of the invention, which comprises generally the same parts as in the before-mentioned lock striker except the stopper plate. In the modification, separated stopper lugs 40 constructed of suitable plastics are used as a substitute for the before-mentioned stopper plate 38. As shown in the drawing, each lug 40 is formed into a wedge and is tightly connected to the corresponding side wall section 26b of the base plate 26 in a manner to make proper location of the keeper bar 34 in the projected state with respect to the elongate hole 24c of the bracket 24 by contacting the side wall 32b of the swingable plate 32 to the inside slanted surfaces of the lugs 40. In this modification, the swinging movement of the swingable plate 32 in the retracting direction is not limited by the stopper lugs 40, but by the bottom section 26a of the base plate 26. Thus, complete retraction of the keeper bar 34 into the space "B" of the same is achieved only by elongating the side wall sections 26b.

Figure 7:
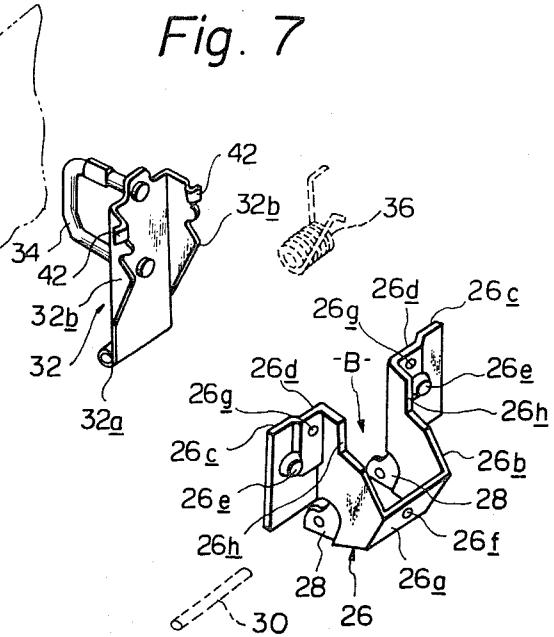
FIG. 7 is a view similar to FIG. 5, but shows another modification of the lock striker.
Figure 8:
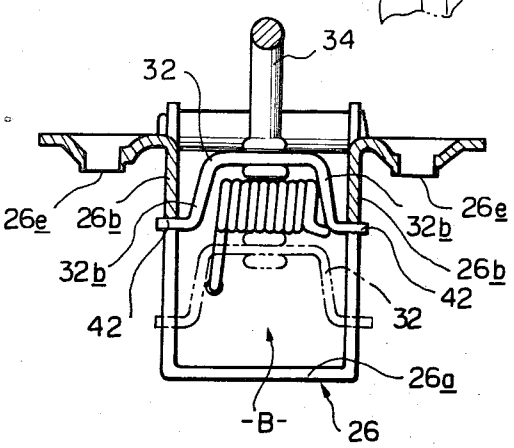
FIG. 8 is a sectional view similar to FIG. 3, showing the modification of FIG. 7.

FIGS. 7 and 8 show another modification of the lock striker of the invention. In this modification, the separate stopping means such as the stopper plate 38 and the stopper lugs 40 which are mentioned above is omitted, and therefor the swingable plate 32 is formed at the side walls 32b with laterally outwardly extending lug portions 42. These lug portions 42 are constructed to be in contact with vertical sections 26h of the side wall sections 26b of the base plate 26 when the swingable plate 32 takes the normal state wherein the keeper bar 34 projects into the luggage compartment "R".

What is claimed is:

1. A mechanism for latching a first member to a second member, comprising:

a bracket secured to said second member to define a certain space between said bracket and said second member;

a base member stationarily disposed in said space;

a swingable plate swingably supported at a portion thereof by said base member, said plate being swingable between first and second positions in said space;

a keeper bar secured to said plate, said keeper bar being projected beyond said bracket when said plate takes said first position and being retracted into said space when said plate takes said second position;

biasing means for biasing said plate to swing in a direction to take said first position; and a hook member connected to said first member, said hook member being engageable with said keeper bar in its projecting state to latch said first member to said second member when said first member is moved toward said second member.

2. A mechanism as claimed in claim 1, in which said bracket has an opening through which said keeper bar passes to be projected beyond said bracket when said swingable plate takes said first position.

3. A mechanism as claimed in claim 1, further comprising a stopper to assure the positioning of said swingable plate to said first and second positions.

4. A mechanism as claimed in claim 1, in which said base member is a generally U-shaped member, said U-shaped member being connected at leg portions thereof to said bracket with a bottom portion thereof which is spaced apart from said bracket to define a certain space between said bottom portion and said bracket, said certain space being sized and constructed to allow the swingable movement of said swingable plate therein.

5. A mechanism as claimed in claim 4, in which said swingable plate has at one end thereof a rounded portion defining a hole through which a shaft is loosely passed, said shaft being supported at both ends by said U-shaped member to extend across the space of the same.

6. A mechanism as claimed in claim 5, further comprising keeper bar locating means which is constructed to make proper location of said keeper bar in the projected state with respect to said bracket when said plate takes said first position.

7. A mechanism as claimed in claim 6, in which said keeper bar locating means comprises:

two side walls formed on said plate; and two lugs respectively connected to said leg portions of said U-shaped member, said side walls being brought into contact with said lugs respectively when said swingable plate takes said first position.

8. A mechanism as claimed in claim 7, further comprising a stopper plate which is secured to said U-shaped member to extend across the space of the same while allowing said swingable plate to be located between the bottom portion of the U-shaped member and said stopper plate.

9. A mechanism as claimed in claim 8, in which said two lugs are integrally connected to said stopper plate.

10. A mechanism as claimed in claim 4, in which said swingable plate is formed with at least one lug portion, said lug portion being brought into contact with a section of the U-shaped base member to limit the swinging movement of said swingable plate toward said first position.

* * * * *